US005160966A

United States Patent [19]

Shiina et al.

[11] Patent Number: 5,160,966

[45] Date of Patent: Nov. 3, 1992

[54] APPARATUS FOR DETECTING TONER SHORTAGE IN DEVELOPING UNIT

[75] Inventors: Yoshio Shiina; Akihiko Kato; Toru Isosu; Makoto Kanno; Akihiko Sato, all of Kanagawa, Japan

[73] Assignee: Fuji Xerox Corporation, Ltd., Tokyo, Japan

[21] Appl. No.: 669,621

[22] Filed: Mar. 14, 1991

[30] Foreign Application Priority Data

Mar. 19, 1990 [JP] Japan ..... 2-67328

[51] Int. Cl.[5] ..... G03G 15/08; G03G 15/00

[52] U.S. Cl. ..... 355/206; 355/246

[58] Field of Search ..... 355/207, 208, 245, 206, 355/203, 204, 205, 209, 246, 4; 118/688, 689, 691

[56] References Cited

U.S. PATENT DOCUMENTS

| | | | |
|---|---|---|---|
| 4,585,327 | 4/1986 | Suzuki | 355/203 X |
| 4,847,659 | 7/1989 | Resch, III | 355/202 |
| 4,851,875 | 7/1989 | Tanimoto | 355/245 |
| 4,870,459 | 9/1989 | Ito et al. | 355/209 |
| 4,951,091 | 8/1990 | Nawata | 355/206 |
| 4,963,927 | 10/1990 | Ishihara | 355/207 |
| 5,005,517 | 4/1991 | Fukui et al. | 118/689 |

*Primary Examiner*—Joan H. Pendegrass
*Assistant Examiner*—Thu Dang
*Attorney, Agent, or Firm*—Finnegan, Henderson, Farabow, Garrett and Dunner

[57] ABSTRACT

In a apparatus for detecting toner shortage in a developing unit for use in an image recording system which forms a latent electrostatic image on a carrier by exposure based on an image signal and which develops the latent image to record the image, provided are a toner shortage sensor in a container for checking as to the presence or absence of a toner in the container at the location of the toner shortage sensor, a counter section for counting in a cumulative manner the number of image prints and the number of pixels produced by the image recording system when the toner shortage sensor detects a toner shortage, the counter section for successively subtracting the number of image prints and the number of pixels from the associated cumulative totals when the sensor detects the presence of toner in the container, and a control section for stopping at least the operation of the image recording system when the sumulative counting value of either the number of image prints or the number of pixels has reached a predetermined value.

7 Claims, 9 Drawing Sheets

APPARATUS FOR DETECTING TONER SHORTAGE IN DEVELOPING UNIT

BACKGROUND OF THE INVENTION

This invention relates to an apparatus for detecting toner shortage in a developing unit used with printers and other image recording systems. More particularly, this invention relates to an apparatus for detecting toner shortage in a developing unit used with remote printers that record image data being sent continuously from a host computer.

An example of the printers used with a developing unit of the type contemplated by the present invention is a "remote printer" that records the image data being supplied continuously from a host computer on a round-the-clock basis. The remote printer is designed to perform recording operations in accordance with operational instructions supplied from the host computer and unlike ordinary copiers, the remote printer is almost always used without being attended by an operator. Hence, the developing unit used in such a remote printer has a lot of toner accommodated in a container so as to produce a large number of prints continuously. Further, the developing unit is equipped with a toner shortage detector that checks for presence or absence of the toner and that indicates toner shortage if there is no toner in the container.

The above conventional toner shortage detector, however, has the following problems. The toner shortage detector is so designed that when the toner is exhausted from the developing unit, the detector immediately gives an indication of toner shortage. However, as already mentioned, the remote printer associated with the developing unit is almost always used without being attended by an operator. Therefore, even if toner shortage is indicated immediately after the loss of toner from the developing unit, the printing operation may continue without the supply of an additional toner. If this occurs, prints having insufficient image density or those which have image skips can be produced in large quantities. Particularly in the case where the printing operation is continued until the toner is completely exhausted from the developing unit, image defects such as clear spots in prints cannot be completely eliminated even after an additional toner is supplied.

With a view to solving these problems, an apparatus for detecting toner shortage in the following manner may be used. When a toner shortage sensor detects the fact that the residual amount of toner in the developing unit has reached a predetermined level, the apparatus displays an instruction for supplying additional toner while the image recording operation is continued using the residual toner in the developing unit. The apparatus counts the number of prints produced after toner shortage is detected by the sensor, and stops the operation of the printer when a predetermined number of prints has been produced.

The operator of this apparatus supplies an additional toner into the container in the developing unit in response to the display indicating the need for toner replenishment and, then, he resets the counter for counting the number of prints to the initial value and resumes the recording operation of the printer. However, if the operator forgets to reset the counter after he supplies an additional toner, the counter will continue the counting operation, permitting the sensor to detect toner shortage in spite of the actual presence of the toner in the container. As a result, when the number of prints counted with the counter reaches a predetermined value, the printing operation of the printer stops. Since the operator may not become aware of this situation until a long time has passed, the "loss time" for which image data being sent from the host computer cannot be printed will be unduly extended.

This problem may be solved by automatically resetting the counter if the toner container is replenished with a toner, causing the toner sensor to detect the presence of the toner. In fact, however, there is no guarantee that the resetting operation is positively performed even if an additional toner is supplied into the container, since toner aggregation and other phenomena may prevent the toner sensor from immediately detecting the presence of the toner. If this occurs, the printer will again stop recording images when the number of prints being counted by the counter has reached a predetermined value. This problem can also occur in the case where a cleaning member is used to prevent toner deposition on the surface of the toner sensor for insuring its normal operation, because any contact between the cleaning member and the surface of the sensor causes the latter to detect the presence of the toner temporarily.

Further, the above apparatus for detecting toner shortage is so designed that a predetermined number of prints can be produced continuously even after the sensor has detected a toner shortage. Additionally the number of prints that can be produced is computed on the basis of image data having a standard image density. Therefore, if image data having a higher image density than the standard density is sent continuously from the host computer, the residual toner in the developing unit will be consumed before the predetermined number of prints are printed, potentially causing density drop or image skipping in the prints obtained.

SUMMARY OF THE INVENTION

The present invention has been accomplished under these circumstances and has as an object providing an apparatus for detecting toner shortage in a developing unit that, when the residual amount of toner in the developing unit has reached a predetermined level, detects that phenomenon, that subsequently counts a quantity proportional to the state of recorded image and that enables the image recording operation until the counted quantity reaches a predetermined level.

Another object of the present invention is to provide an apparatus for detecting toner shortage in a developing unit that, when the developing unit is replenished with a toner, resets the counting value of a quantity proportional to the state of recorded image in an automatic and positive way, and that stops the printing operation when a predetermined amount of toner has been actually consumed before the counting value of the quantity proportional to the state of recorded image reaches a predetermined value, whereby the occurrence of print defects such as density drop and image skipping can be prevented.

An apparatus according to the invention for detecting toner shortage in a developing unit for use in an image recording system that forms a latent electrostatic image on a carrier by exposure based on an image signal and that develops the latent image to achieve an image recording operation, the apparatus comprises: toner shortage sensor means, provided in a predetermined location within the developing unit, for checking as to the presence or absence of a toner; counter means for counting in a cumulative manner the number of image prints and the number of pixels in an image signal during a detection operation of toner shortage by the toner shortage sensor means; and control means for stopping at least the operation of the image recording system when the cumulative counting value of either the number of image prints or the number of pixels has reached a predetermined value, the number of image prints and the number of pixels being counted by the counter means in a cumulative manner when the toner shortage sensor means detects toner shortage, and the number of image prints and the number of pixels being successively subtracted from the associated cumulative counting values respectively when the sensor means no longer detects toner shortage.

DETAILED DESCRIPTION OF THE PREFERRED EMBODIMENT

The present invention will be described below in detail with reference to the accompanying drawings.

Figure 2:
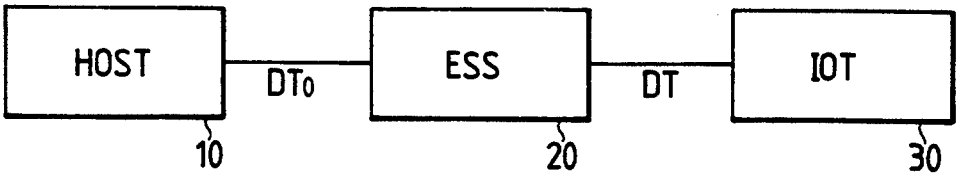
FIG. 2 is a block diagram showing the connection of a remote printer to a host computer.
Figure 3:
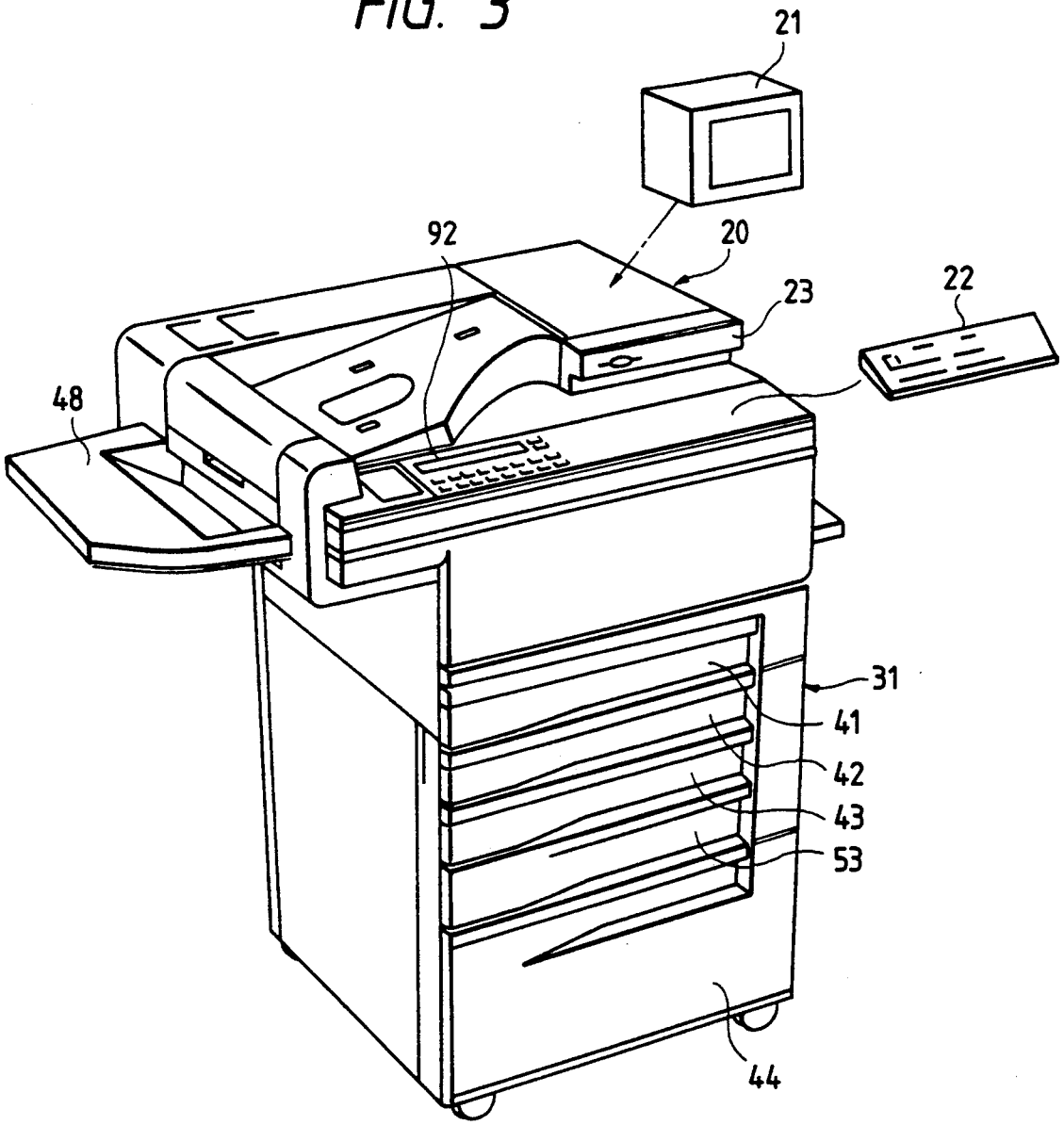
FIG. 3 is a perspective view showing the general appearance of the remote printer.

FIG. 3 shows the general appearance of a remote printer incorporating the apparatus of the present invention for detecting toner shortage in a developing unit. As shown in FIG. 2, the remote printer includes an ESS (interface) 20 which converts image data $DT_0$ transferred from a host computer 10 to image data DT in a predetermined format, and an IOT (Image Output Terminal) 30 which reproduces an image on a recording sheet (not shown) on the basis of the image data DT from the ESS 20.

As shown in FIG. 3, the ESS 20 is installed on the top of the housing 31 of the IOT 30 and is equipped with a CRT display 21, a keyboard 22 for performing menu selection and executing various jobs, and a floppy unit 23 that reads image data preliminarily loaded in a floppy disk (not shown). Further, a control panel 92 for displaying a state such as "toner shortage" is provided adjacent to the keyboard 22.

Figure 4:
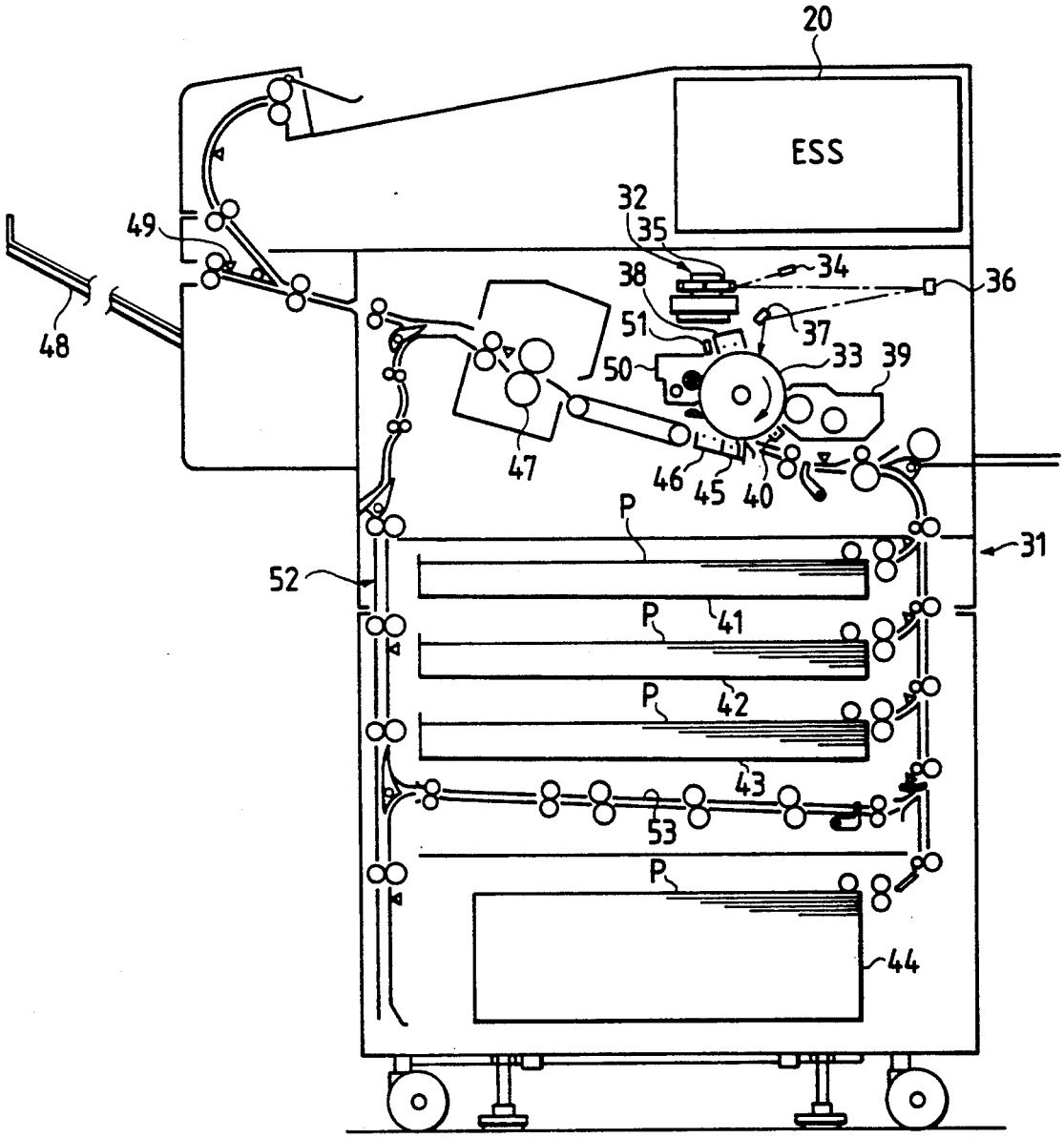
FIG. 4 is a diagram showing schematically the construction of the remote printer.

The construction of the IOT 30 in the remote printer is described below in association with the printing operations. First, image data DT being transferred from the ESS 20 is converted to an optical signal by means of an ROS (raster output scanner) unit 32, which scans the surface of a photoreceptor drum 33 for exposure as shown in FIG. 4.

The ROS unit 32 comprises a single semiconductor laser 34, a polygonal mirror 35 that reflects a beam Bm from the semiconductor laser 34 by a rotating reflecting face thereof to guide the beam Bm over a predetermined scan range, and mirrors 36 and 37 that reflect the beam Bm from the polygonal mirror 35 to be directed toward the photoreceptor drum 33. The ROS unit 32 is so designed that the laser beam Bm emitted from the semiconductor laser 34 which oscillates in accordance with the image data DT is scanned along the axis of the photoreceptor drum 33 by means of the polygonal mirror 35, whereby the surface of the photoreceptor drum 33 is exposed imagewise as a function of the image data DT.

The photoreceptor on the drum 33 may be formed of an organic photoconductive (OPC) material but other materials may of course be used. The photoreceptor drum 33 is adapted to be rotatable by a drive means (not shown) in the direction indicated by an arrow in FIG. 4. The surface of the photoreceptor drum 33 is preliminarily electrified or charged with a primary charging device 38 to form a uniform charge layer at a predetermined potential and subsequently, the drum is scanned imagewise with the ROS unit 32 in the manner described above to form a latent electrostatic image on the surface of the drum.

The latent electrostatic image is developed with a black toner in a developing unit 39 to form a toner image. The toner image is then charged with a pretransfer charging device 40 and its potential increases whereas the potential of the background decreases to facilitate the subsequent transfer of the toner image.

The toner image on the photoreceptor drum 33 is charged with a transfer charging device 45 to be transferred onto a sheet of recording paper P having a selected size that is supplied from either one of paper feed cassettes 41, 42, 43 and 44 installed within the printer. The recording paper P having the toner image transferred thereto is charged with a separation charging device 46 to be separated from the photoreceptor drum 33 and is thereafter carried into a fusing unit 47, where the toner image is fixed onto the recording paper P.

In the normal recording mode, the recording paper P having the toner image fixed thereon is immediately ejected to a receiving tray 48. A sensor 49 for sensing the passage of recording paper P is provided in the area where the recording paper P is ejected.

The surface of the photoreceptor drum 33 is cleaned with a cleaner 50 to remove any foreign matter such as residual toner and paper particles. At the same time, the photoreceptor drum 33 is illuminated with light from an erasure lamp 51 to erase any residual charges so that the photoreceptor is conditioned for the next cycle of image recording.

In other recording modes such as two-side recording or one-side multiple recording, the recording paper P having the toner image fixed is not immediately ejected to the receiving tray 48. Instead, it is guided along a transport path 52 and an intermediate tray 53 to be transported again into the image recording section either as it is or after it is turned inside out, and a predetermined toner image is recorded in that section. Only after the transfer and fixing operations for the predetermined image has been repeated the necessary number of the times is the recording paper P ejected into the receiving tray 48.

Figure 5:
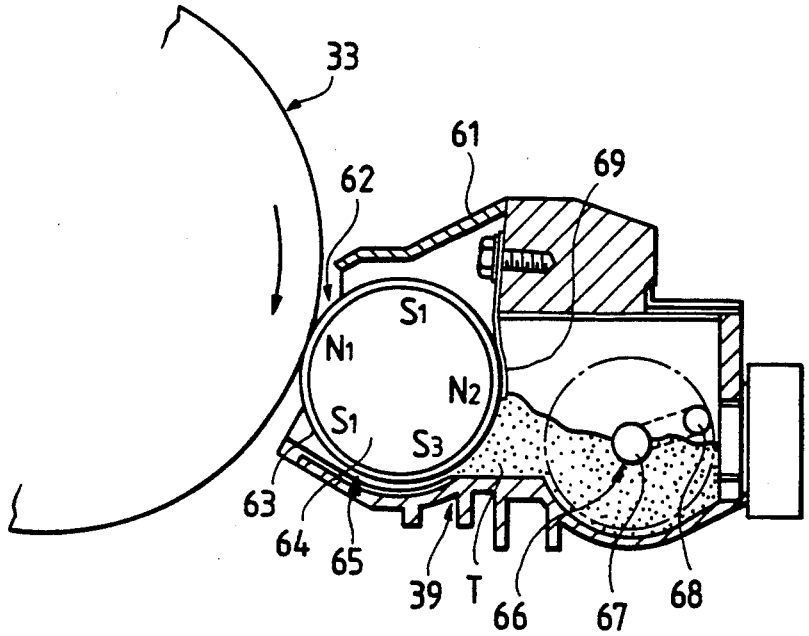
FIG. 5 is a longitudinal section of the developing unit.
Figure 6:
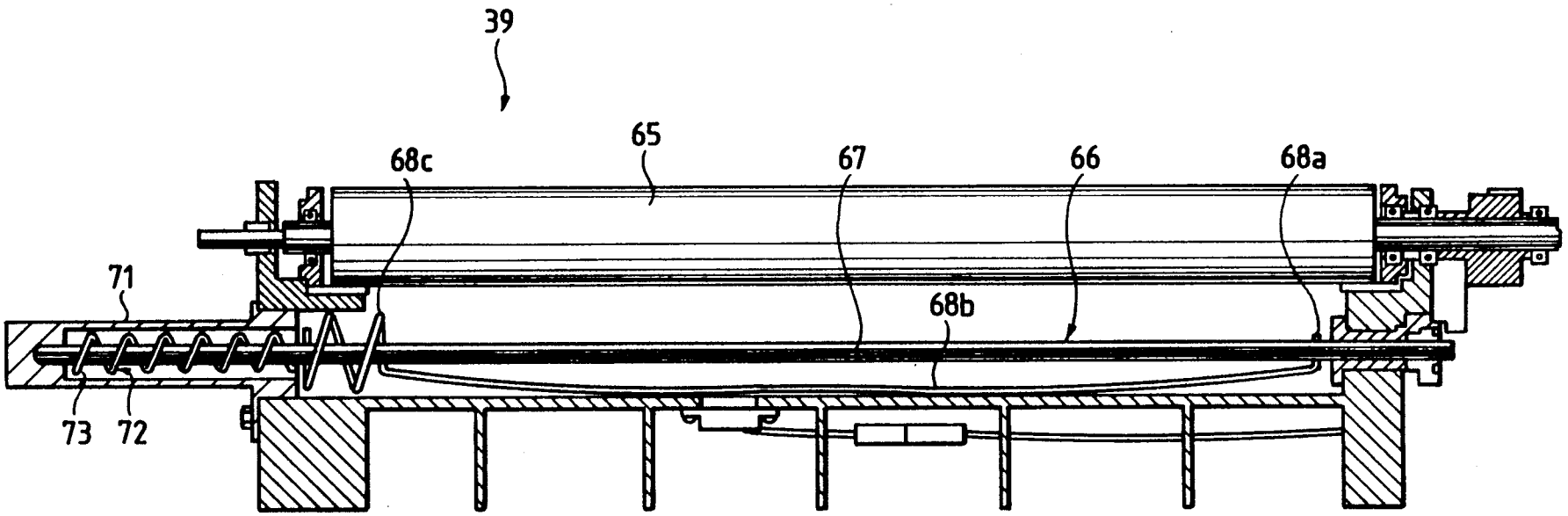
FIG. 6 is a transverse section of the developing unit.

FIGS. 5 through 9 show an embodiment of the developing unit incorporating the apparatus of the present invention for detecting toner shortage in that unit. In FIG. 5, the body of a developing unit 61 is formed like a box having a generally U-shaped cross section. The body 61 has an opening 62 on the side where the opening 62 is in substantial contact with the photoreceptor drum 33. Inside the body 61 and adjacent to the opening 62 is provided a development roll 65 comprising a rotatable development sleeve 63 and a magnet roll 64 fixed within the sleeve 63. Also provided within the body 61 but farther away from the opening 62 is an agitator 66 that supplies with a single-component (solely composed of toner T) developer under agitation. The agitator 66 is composed of a shaft 67 supported rotatably about an axis provided on the side wall of the body 61 and a coil 68 secured to the shaft 67. As shown in FIG. 6, the coil 68 is fixed at its front end portion 68*a* to one end of the shaft 67 whereas the center portion 68*b* is curved with a large radius along the length of the shaft 67 and the other end portion 68*c* forms a helical coil that aids in transporting the toner T.

The toner T within the body of the developing unit 61 is supplied to the development roll 65 by means of the agitator 66 as shown in FIG. 5. The supplied toner T is deposited on the surface of the development roll 65, as attracted by the magnetic force of the magnet roll 64 provided within the development roll 65, while the toner is moved upward as the development sleeve 63 rotates. As the toner moves upward, the toner forms a uniform thickness of layer on the surface of the development sleeve 63 with its thickness being defined by a trimmer blade 69 extending downward from the ceiling of the body of the developing unit 61. The toner T deposited on the surface of the development sleeve 63 is transported to a position in close proximity to the photoreceptor drum 33. The latent electrostatic image formed on the surface of the drum 33 is developed by applying a predetermined developing bias to the development sleeve 63.

As shown in FIG. 6, an auger pipe 71 for supplying toner T from a toner supply section 74 to be described below extends from one side wall of the body of the developing unit 61, and an auger 72 is provided rotatably within the auger pipe 71. The auger 72 shares a part with the agitator 66 and is composed of a plate member that is wound helically around the shaft 67 of the agitator 66 to form a coil having a smaller diameter than that of the coil 68.

Figure 7:
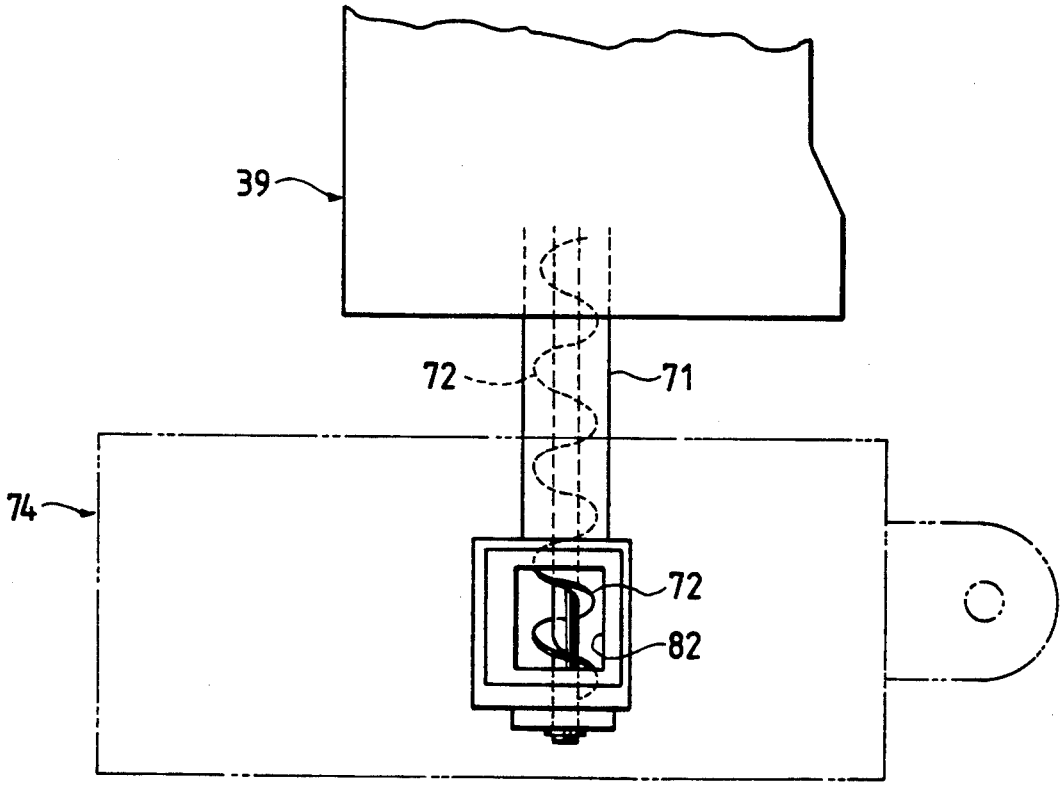
FIG. 7 is a plan view illustrating the relationship between the body of the developing unit and the toner supply section.
Figure 8:
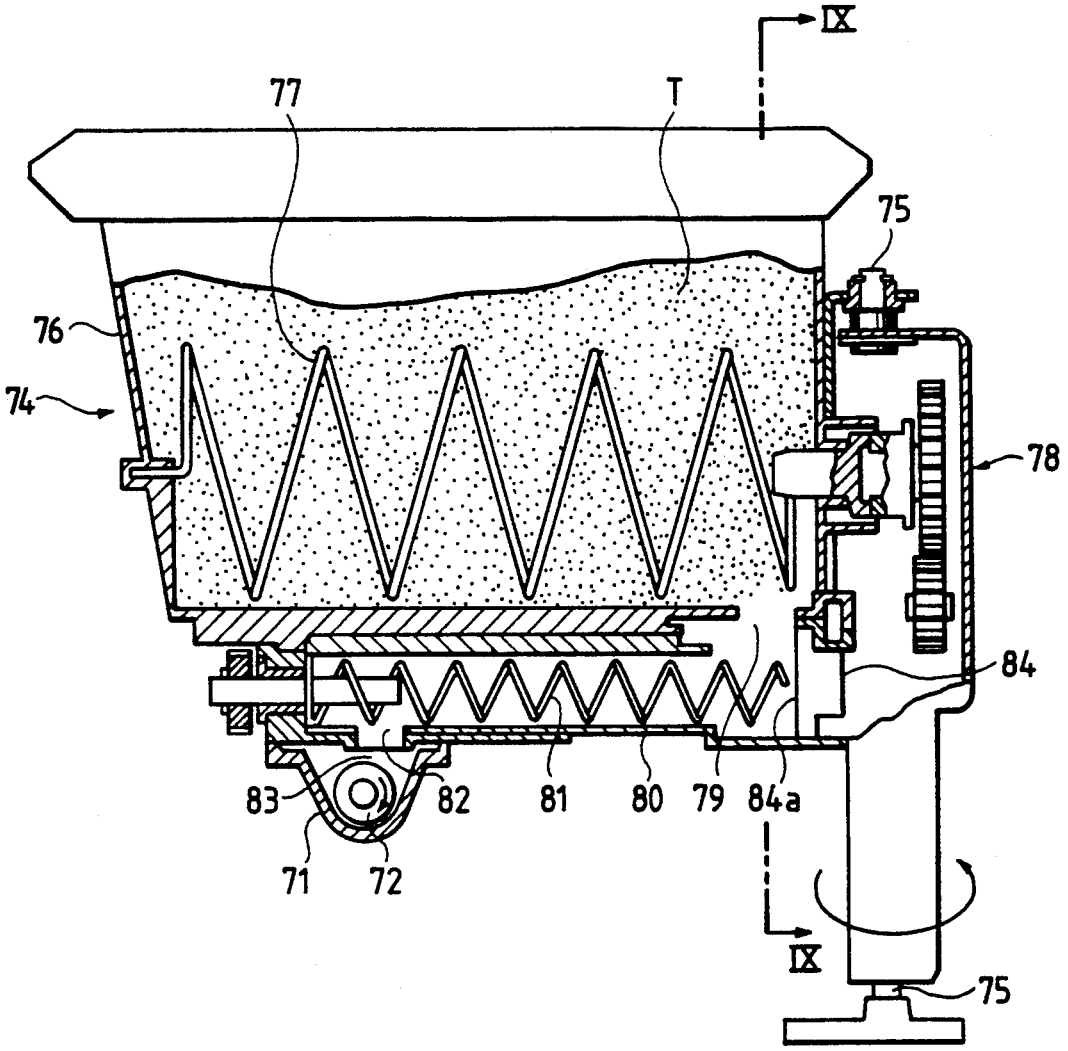
FIG. 8 is a longitudinal section of the toner supply section.

The toner supply section 74 for supplying toner T into the body of the developing unit 61 is provided on one side of the latter as shown in FIG. 7. This toner supply section 74 is adapted to be rotatable in a horizontal plane by means of a rotating shaft 75 as shown in FIG. 8.

Figure 9:
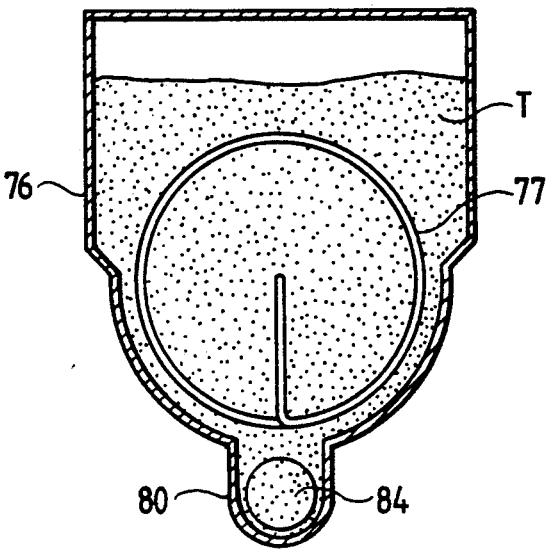
FIG. 9 is a cross-section of FIG. 8 taken on the line IX—IX.

A toner container 76 is formed like a box that contains toner T therein. The toner container 76 is a cartridge that is detachably provided in the toner supply section 74. Hence, the replenishment of toner T can be readily effected by replacing an empty toner container 76 with a toner-filled container. The toner container 76 is provided with an agitator 77 in coil form that serves as an agitating means which prevents the blocking of toner T by agitating it at predetermined time intervals as shown in FIG. 9. The drive force to the agitator 77 is supplied from a drive section 78 in the toner supply section 74 which becomes operatively coupled to one end of the agitator 77 when the toner container 76 is set in the toner supply section 74.

An opening 79 for letting out toner T is formed at one end of the bottom of the toner container 76, and this opening 79 is communicated with a tubular guide section 80 having a generally U-shaped cross section. This tubular guide section 80 has in its interior an auger 81 that is provided rotatably to transport toner T that is supplied from the toner container as the toner drops through the opening 79. Toner T transported by the auger 81 is guided through a supply port 82 in the bottom of the other end of the tubular guide section 80 to be supplied into an opening 83 in the auger pipe 71 projecting beyond the body of the developing unit 61. As already mentioned, the toner T supplied into the opening 83 in the auger pipe 71 is then transported into the body of the developing unit 61 by means of the auger 72.

In the embodiment under discussion, the toner supply section 74 has a toner shortage sensor 84 that is composed of a piezoelectric device for detecting the presence or absence of toner T. This toner shortage sensor 84 is attached to the side wall of an end of the tubular guide section 80 just below the opening 79 in the toner container 76 in such a way that a circular sensing face 84*a* of the sensor 84 is flush with the side wall of the end of the tubular guide section 80 to which the sensor 84 is attached. The piezoelectric device is vibrated in different ways depending on whether toner T contacts the sensing face 84*a* of the sensor 84 and this is how the sensor detects the presence or absence of toner T in the container 76.

Figure 1:
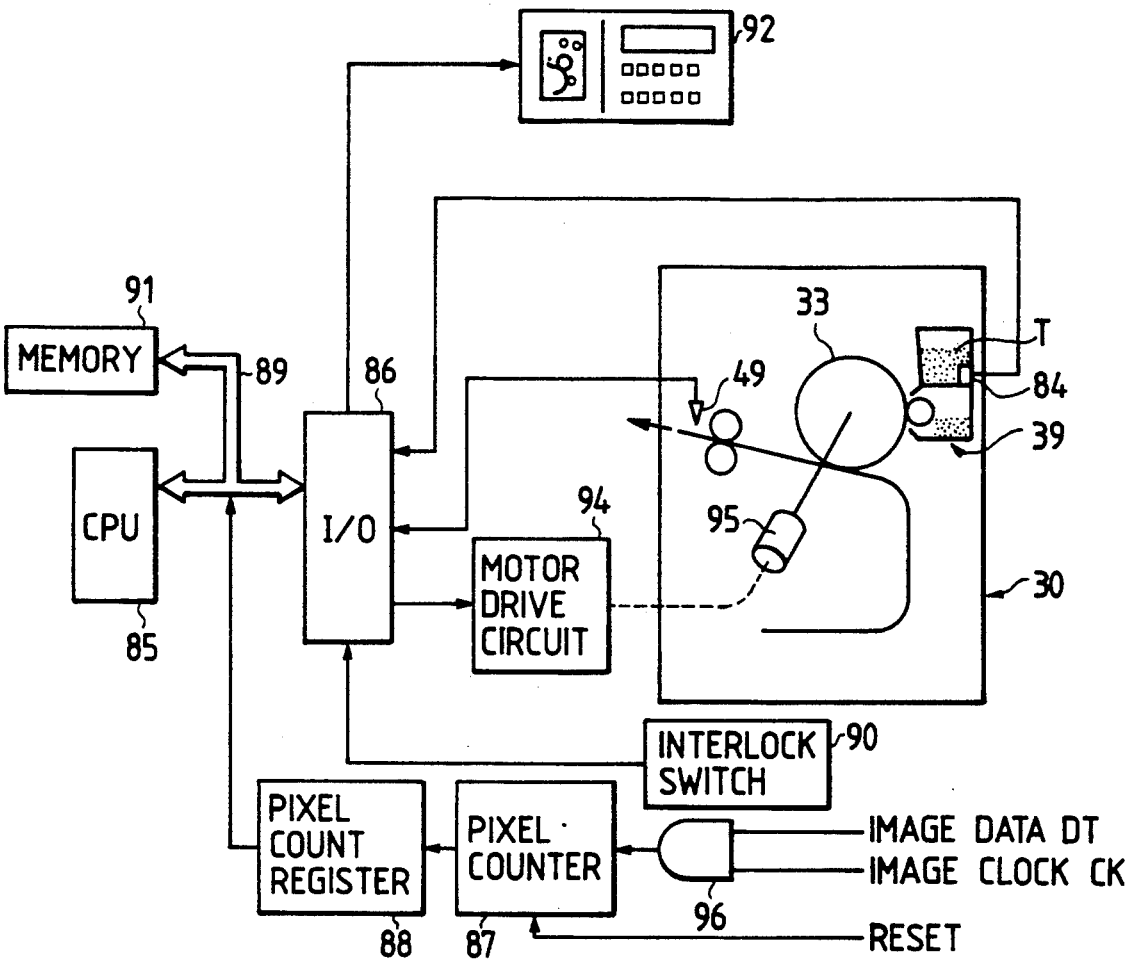
FIG. 1 is a block diagram showing an apparatus for detecting toner shortage in a developing unit according to an embodiment of the present invention.

FIG. 1 is a block diagram showing the control system of the apparatus for detecting toner shortage according to the embodiment under discussion.

In FIG. 1, a CPU (Central Processing Unit) 85 controls the overall operations of the remote printer. The CPU 85 is supplied through an I/0 port 86 with an output signal from the toner shortage sensor 84 and an output signal from the paper sensor 49. Image data DT to be used for forming a latent image on the photoreceptor drum 33 is supplied to a pixel counter 87 through an AND circuit 96 to which image clock CK is supplied. The counting value of the pixel counter 87 is supplied to the CPU 85 through a pixel count register 88 and a system bus 89. A non-volatile memory 91 connected to the CPU 85 through the system bus 89 is provided for storing counting values and other data. The CPU 85 is also adapted to receive through the 1/0 port 86 a signal from an interlock switch 90 that detects the opening or closing of a printer cover (not shown) on the body of the printer which is opened or closed as required in such cases as the replacement of the toner container 76 in the developing unit 39

Further, the CPU 85 applies a display control signal to the control panel 92 for displaying a state such as "toner shortage" through the I/0 port 86. Furthermore, the CPU 85 applies a drive signal to a motor drive circuit 94 connected to a drive motor 95 for rotating the photoreceptor drum 33.

The apparatus for detecting toner shortage in the developing unit according to the embodiment detects toner shortage and performs the necessary control operations in the manner described below. First, in response to the image data $DT_0$ transferred from the host computer 10, the remote printer starts the printing operation (Step 1 in FIG. 10). As the printing operation proceeds, toner T in the toner container 76 in the developing unit 39 is gradually consumed. As shown in FIG. 8, toner T in the toner container 76 is supplied into the tubular guide section 80 as it drops through the opening 79 in the bottom of the container 76. Toner T supplied into the tubular guide section 80 is transported by means of the auger 81 and thence supplied into the body of the developing unit 61 through the auger pipe 71 as already mentioned above.

Figure 11:
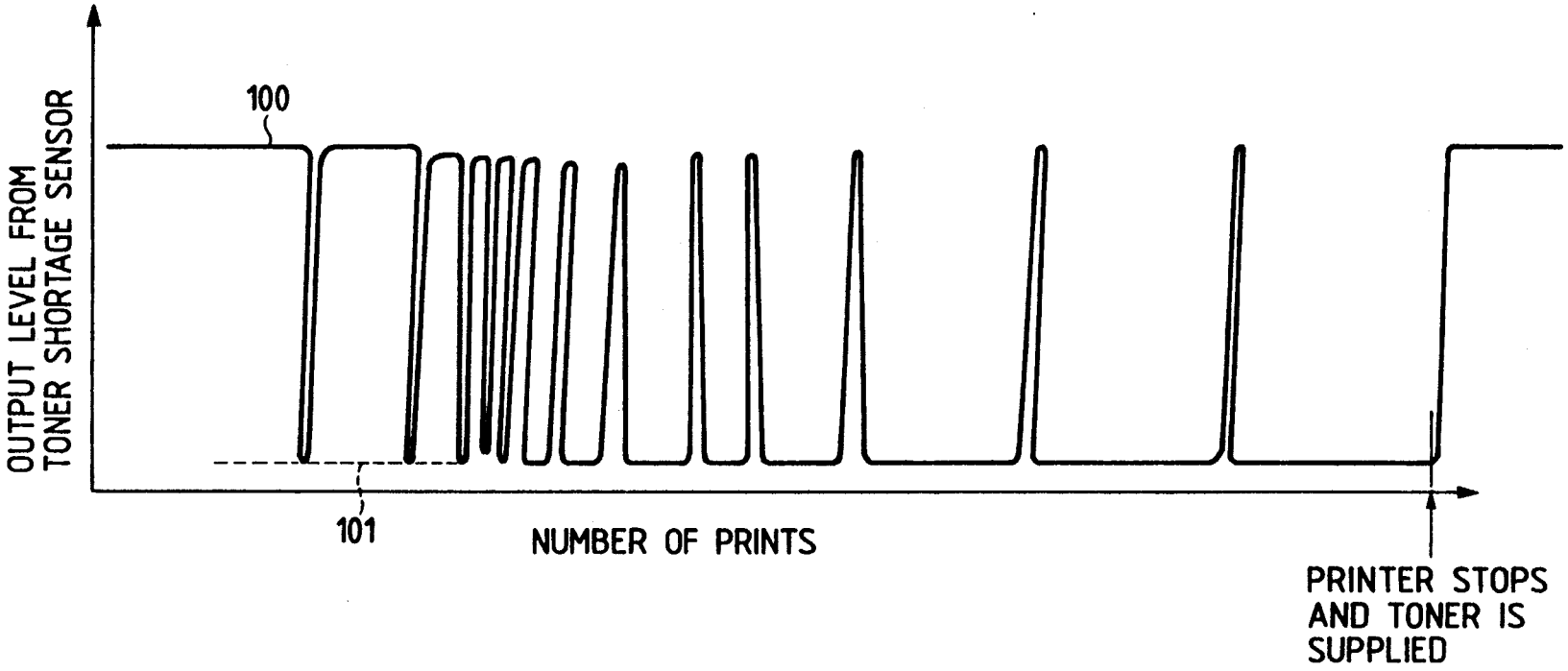
FIG. 11 is a diagram showing the waveform of a signal from a toner shortage sensor.

Toner T being supplied into the tubular guide section 80 through the opening 79 in the bottom of the toner container 76 is checked for its presence or absence by means of the toner shortage sensor 84 which produces a detection signal. As shown in FIG. 11, the detection signal from the sensor 84 consists of a "H" level signal 100 that is produced when toner T is present on the front face of the sensor 84 and a "L" level signal 101 that is produced when toner T is not present on that front face. It should, however, be noted that the "L" level signal 101 is not produced only in the case where toner T is absent in the toner container 76; it may be delivered temporarily in such cases as where toner blocking in the container 76 prevents toner T from being supplied to the front face of the sensor 84 through the opening 79 in the container 76. The signal produced from the toner shortage sensor 84 is not checked by the CPU 85 at all times but only at given time intervals, so the result of checking for the presence or absence of toner T will also vary depending on the time at which the signal from the sensor 84 is checked by the CPU 85. Hence, in the embodiment under discussion, the signal from the toner shortage sensor 84 is checked once at each interval of 100 msec and the state where a "L" level signal 101 indicating the absence of toner is produced continuously for a period of at least 1,000 msec is defined as "toner shortage".

When the toner shortage sensor 84 detects toner shortage, the CPU 85 performs the operation of counting the number of prints in parallel with the counting operation on the image data to be recorded in the manner described below.

Counting Operation for the Number of Prints

Figure 10:
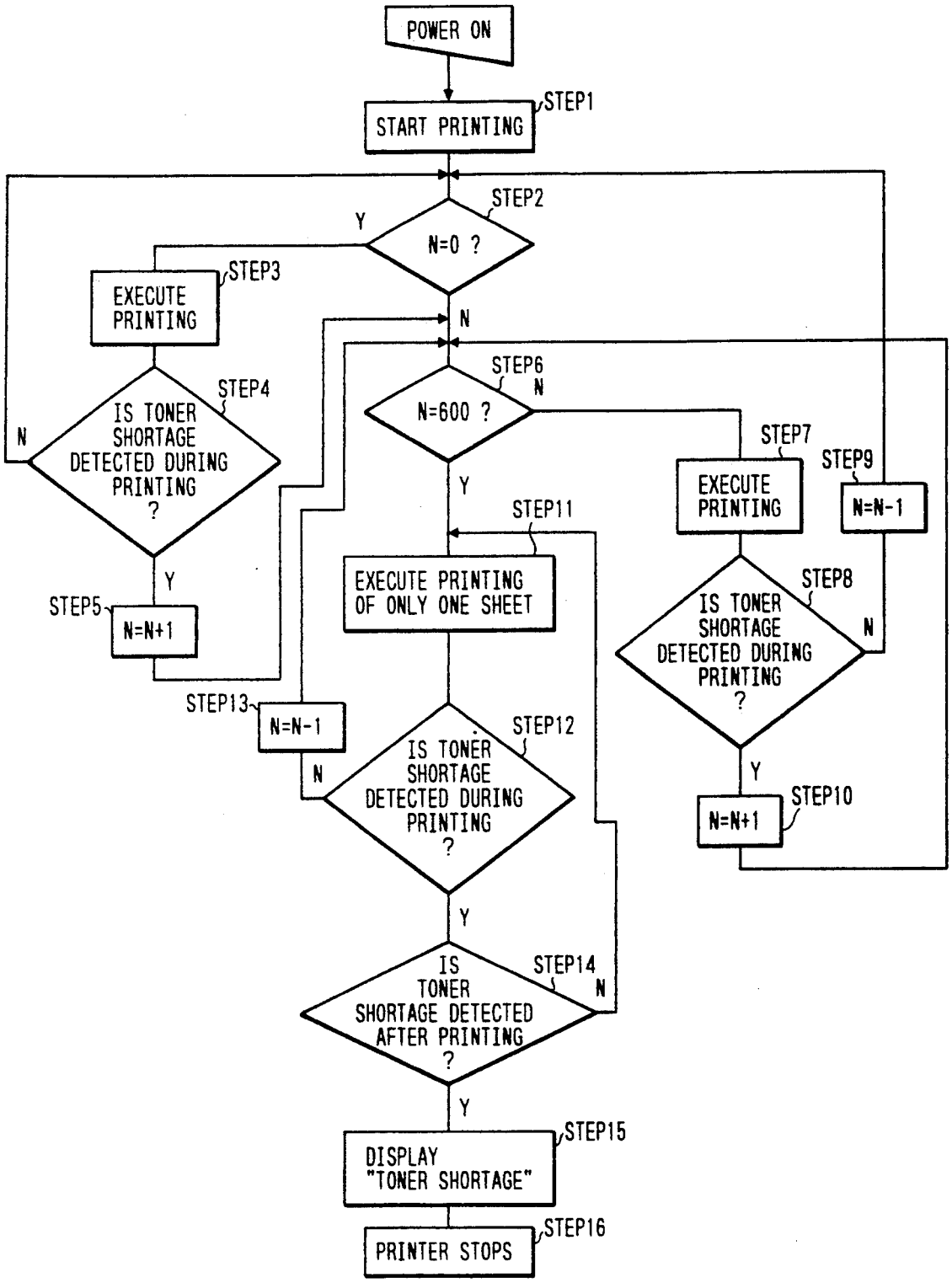
FIG. 10 is a flowchart showing the operation of the apparatus for detecting toner shortage in the developing unit.

As shown in FIG. 10, CPU 85 checks if the counting value N is zero or not and, if the counting value N is zero, the CPU executes the printing operation (Steps 2 and 3). Then, the CPU 85 checks during the printing operation the output signal from the toner shortage sensor 84 once at every interval of 100 msec to see whether the sensor 84 delivers a "L" level signal 101 that continues for a period of at least 1,000 msec, namely, whether the detection signal from the sensor 84 indicates toner shortage during the printing operation (Step 4). If the answer is negative (no toner shortage), the CPU 85 returns to Step 2. If the answer is affirmative (toner shortage), the CPU 85 displays a message for "toner shortage in container 76" on the control panel 92 in the printer and adds "1" to the counting value N of recording paper P (Step 5). The number of sheets of recording paper P is known by counting the output signals from the paper sensor 49 provided in the paper ejecting portion of the printer. As shown in FIG. 1, the counting value N of recording paper P is stored in the non-volatile memory 91 connected to CPU 85 through system bus 89.

Then, the CPU 85 checks if the counting value N for the number of prints is equal to a preset value such as 600 (Step 6). If the counting value N is less than the preset value ($1 \leqq N < 600$), the CPU 85 continues the execution of the printing operation (Step 7). Subsequently, the CPU 85 checks if toner shortage is detected by the sensor 84 during the printing operation (Step 8). If the answer is negative, the CPU 85 subtracts "1" from the counting value N (Step 9) and returns to Step 2. If the answer is affirmative, the CPU 85 adds "1" to the counting value N (Step 10) and returns to Step 6.

If the operator looking at the display on the control panel 92 becomes aware of toner shortage in the container 76 and supplies it with an additional toner, the counting value N is successively decreased by "1" every time the printing operation is preformed in Steps 7 and 8, whereby the counting value N is automatically reset. When the counting value N is reduced to zero in Step 2, the CPU 85 permits the printing operation to be continued not in the state of "toner shortage" but in the normal state of "toner presence" (Step 3).

If the counting value N is no longer zero in Step 2, the CPU 85 proceeds to Step 6 where the CPU 85 checks if the counting value N is equal to 600 or not. If the answer is affirmative, the CPU 85 performs the following operation. Namely, the CPU 85 executes the printing operation of only one sheet (Step 11) and checks if the sensor 84 has detected toner shortage during the printing operation (Step 12) If the answer is negative, the CPU subtracts "1" from the counting value N (Step 13) and returns to Step 6. If toner shortage is detected during the printing operation, the CPU 85 checks for toner shortage after the end of printing (Step 14). If the answer is negative, the counting value N is found to be equal to 600 and CPU 85 returns to Step 11 where the printing operation is executed to produce only one print.

As described above, the CPU 85 does not cease the printing operation as soon as the counting value N becomes equal to 600. This is because even if an additional toner is supplied into the container 76, toner blocking may occur to have the sensor 84 detect "toner shortage". Under these circumstances, the program is adapted to execute the printing operation of one more sheet, and Steps 11, 12 and 14 are repeated once again to make sure that no toner has been actually supplied into the container 76.

If toner shortage is detected both during and after the printing operation, namely, in the case where no additional toner is supplied and the container 76 remains empty, the CPU 85 allows the control panel 92 in the printer to display a final message for toner shortage in the developing unit 39. At the same time, as shown in FIG. 1, the CPU 85 sends a control signal to the motor drive circuit 94 to stop the drive motor 95 which has been rotationally driving the photoreceptor drum 33 (Steps 15 and 16).

When the printer comes to rest, the operational state returns to one associated with $N=600$ (Step 11) so that one page or sheet can be printed when a power source switch (not shown) to the printer or the interlock switch 90 for detecting the opening or closing of the printer cover is turned on or off.

When additional toner is supplied in the state which permits one page or sheet to be printed, toner shortage will not be detected during the printing operation (Step 12), so "1" is subtracted from the counting value N (Step 13) and the CPU 85 returns to Step 6. Since in this case, the counting value N is no longer equal to 600, the CPU 85 proceeds to Step 7 and executes printing. Thereafter, the CPU 85 checks if sensor 84 has detected toner shortage during the printing operation (Step 8) and since the answer is negative, "1" is subtracted from the counting value N (Step 9) and the CPU 85 returns to Step 2. Since the counting value N is not zero, the operations of Steps through 9 are repeated and at each printing, the counting value N is successively decreased by "1" until the value N becomes equal to zero, whereupon CPU 85 at Step 2 resumes the normal operation in the presence of toner T (Steps 3 and 4).

Counting Operation for Image Data

Figure 12:
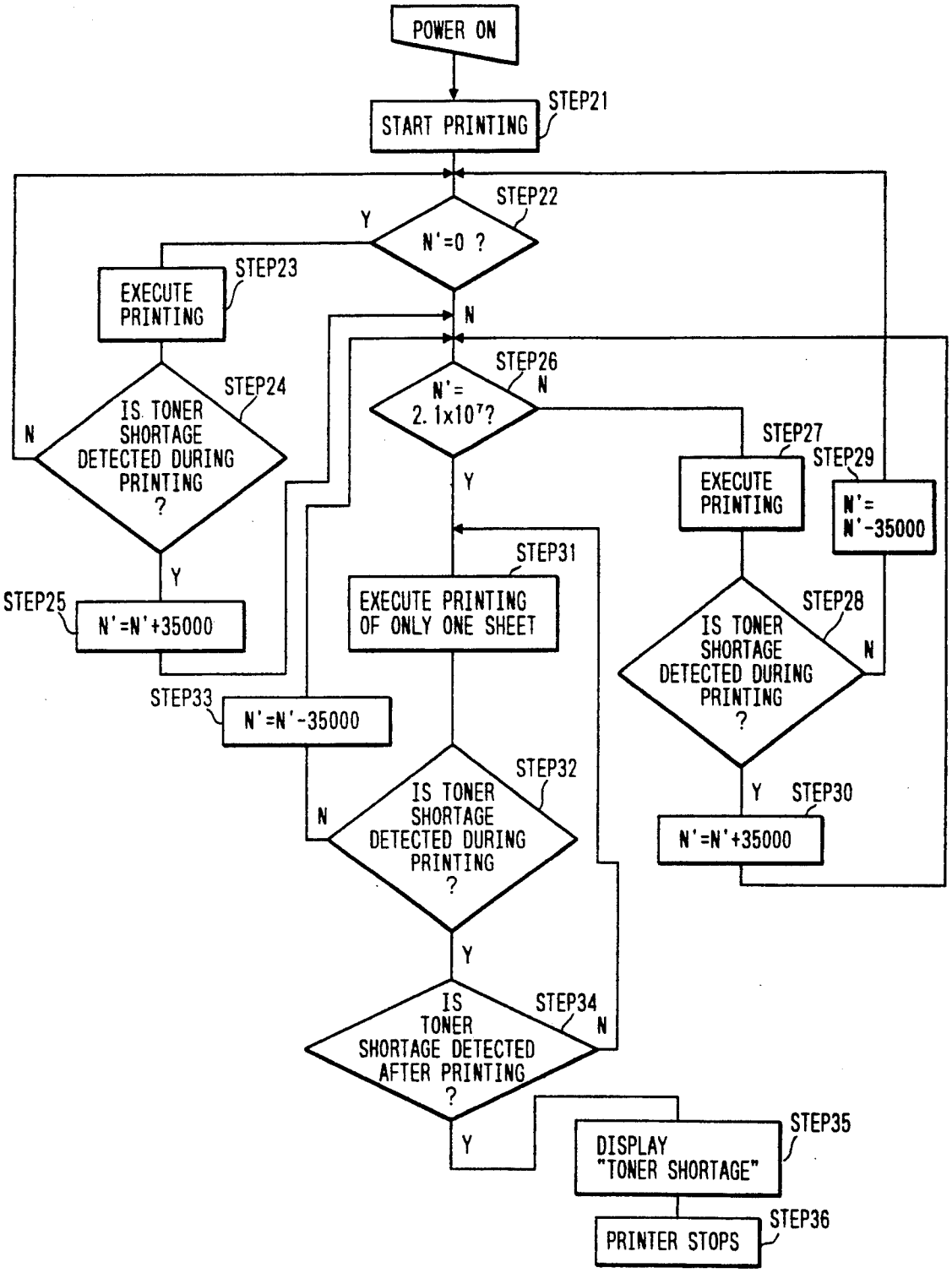
FIG. 12 is another flowchart showing the operation of the apparatus for detecting toner shortage.

As shown in FIG. 12, the remote printer starts the printing operation, and the CPU 85 checks if the counting value N' of pixels in the image data DT is zero or not (Steps 21 and 22). If the counting value N' is zero, the CPU executes the printing operation (Step 23). Then, the CPU 85 checks during the printing operation the output signal from the toner shortage sensor 84 once at every interval of 100 msec to see whether the sensor 84 delivers a "L" level signal 101 that continues for a period of at least 1,000 msec, namely, whether the detection signal from the sensor 84 indicates toner shortage during the printing operation (Step 24). If the answer is negative (no toner shortage), the CPU 85 returns to Step 22. If the answer is affirmative (toner shortage), the CPU 85 displays a message for "toner shortage in container 76" on the control panel 92 in the printer and adds "35,000" to the counting value N' of pixels in the image data DT (Step 25). The number of pixels is counted by supplying image data DT and image clock CK into the pixel counter 87 through the AND circuit 96, and the counting value N' of pixels is read into the register 88 as shown in FIG. 1. Then, the counting value N, is stored in the non-volatile memory 91 connected to the CPU 85 through the system bus 89.

Then, the CPU 85 checks if the counting value N' of pixels is equal to a present value $2.1 \times 10^7$ (Step 26). If the counting value N' is less than the present value ($1 \leqq N < 2.1 \times 10^7$), the CPU 85 continues the execution of the printing operation (Step 27). Subsequently, the CPU 85 checks if toner shortage is detected by the sensor 84 during the printing operation (Step 28). If the answer is negative, the CPU 85 subtracts 35,000 from the counting value N, (Step 29) and returns to Step 22. If the answer is affirmative, the CPU 85 adds "35,000" to the counting value N, (Step 30) and returns to Step 26.

The value "35,000" is an example of the counting value of pixels in the image data DT sampled at 10-msec intervals during the detection of toner shortage in the case where the image data DT is recorded at a density of 5% on one sheet of recording paper P of size A4.

When the counting value N' is reduced to zero in Step 22, the CPU 85 permits the printing operation to be continued not in the state of "toner shortage" but in the normal state of "toner presence" (Step 23).

If the counting value N' is no longer zero in Step 22, the CPU 85 proceeds to Step 26 where the CPU checks if the counting value N' is equal to $2.1 \times 10^7$ or not. If the counting value N' is more than $2.1 \times 10^7$, the CPU 85 performs the following operation assuming that $N' = 2.1 \times 10^7$. Namely, the CPU 85 executes the printing operation of only one sheet (Step 31) and checks if the sensor 84 has detected toner shortage during the printing operation (Step 32). If the answer is negative, the CPU 85 subtracts "35,000" from the counting value N, (Step 33) and returns to Step 26.

If toner shortage is detected during the printing operation, the CPU 85 checks for toner shortage after the end of printing (Step 34). If the answer is negative, N' is found to be equal to $2.1 \times 10^7$ and the CPU 85 returns to Step 31 where the printing operation is executed to produce only one print. If toner shortage is detected both during and after the printing operation, the CPU 85 allows the control panel 92 in the printer to display a final message for toner shortage in the developing unit 39. At the same time, the CPU 85 sends a signal to the motor drive circuit 94 to stop the drive motor 95 which has been rotationally driving the photoreceptor drum 33 (Steps 35 and 36).

When the printer comes to a rest, its operational state returns to one associated with $N' = 2.1 \times 10^7$ (Step 31) so that one page or sheet can be printed when the power source switch (not shown) to the printer or the interlock switch 90 for detecting the opening or closing of the printer cover is turned on or off.

When an additional toner is supplied in this state which permits one page of sheet to be printed, toner shortage will not be detected during the printing operation (Step 32), so "35,000" is subtracted from the counting value N' (Step 33) and the CPU 85 returns to Step 26. Since in this case, the counting value N' is no longer equal to $2.1 \times 10^7$, the CPU 85 proceeds to Step 27 and executes printing. Thereafter, the CPU 85 checks if the sensor 84 has detected toner shortage during the printing operation (Step 28) and since the answer is negative, "35,000" is subtracted from the counting value N' (Step 29) and the CPU 85 returns to Step 22. Since the counting value N' is not zero, the operations of Steps 27 through 29 are repeated and at each printing, N' is successively decreased by "35,000" until N, becomes equal to zero, whereupon the CPU 85 at Step 22 resumes the normal operation in the presence of toner T (Steps 23 and 24).

As described on the foregoing pages, toner shortage in the container 76 is detected with the toner shortage sensor 84, and the number of sheets of recording paper P and the number of pixels in the image data when the sensor 84 is detecting toner shortage are counted in a cumulative way by CPU 85 and counter 87. Further, when the cumulative counting value of either the number of sheets of recording paper P or the number of pixels in the image data has reached a predetermined value $N' = 600$ or $N' = 2.1 \times 10^7$, the CPU 85 stops the operation of the printer while displaying the indication of toner shortage. Because of this arrangement, the predetermined number of image prints can be obtained even if toner replenishment is not immediately performed after toner shortage occurs in the container 76. If, on the other hand, the toner container 76 in the developing unit 39 is supplied with an additional toner, causing the sensor 84 to no longer detect toner shortage, the number of sheets of recording paper P and the number of pixels in the image data are successively subtracted from the counting values N and N' obtained by the CPU 85 and counter 87 respectively. Hence, even if the operator does not reset the CPU 85 or the counter 87, they are reset in an automatic and positive way by subtracting the number of sheets of recording paper P and the number of pixels in the image data from the respective counting values. This effectively prevents the occurrence of print defects such as density drop or image skipping which would otherwise take place if the CPU 85 or counter 87 were not reset despite the supply of additional toner T into the container 76 in the developing unit 39. Further, even if the image recording operation is continued without additional toner T being supplied into the container 76 in the developing unit 39, the CPU 85 stops the operation of the printer when either the number of sheets of printing paper P or the number of pixels in the image data that are counted by the CPU 85 and the counter 87 has reached the predetermined values $N=600$ or $N'=2.1\times 10^7$, respectively. This prevents the occurrence of print defects such as density drop or image skipping. As a further advantage, the CPU 85 and the counter 87 count not only the number of sheets of printing paper P but also the number of pixels in the image data, so even if image data having high image density is recorded continuously, information on the actual amount of toner consumption can be obtained on the basis of the number of pixels in the image data and this again prevents the occurrence of print defects such as density drop or image skips.

In short, the present invention provides an apparatus for detecting toner shortage in a developing unit, when the residual amount of toner in the developing unit has reached a predetermined level, detects that phenomenon, and that subsequently counts a quantity proportional to the state of recorded image enable image recording until the counted quantity reaches a predetermined level. When the developing unit is replenished with a toner, the apparatus resets the counting value of the quantity proportional to the state of the recorded image in an automatic and positive way. Further, the apparatus stops the printing operation when a predetermined amount of toner has been actually consumed before the counting value of the quantity proportional to the state of recorded image reaches a predetermined value, whereby the occurrence of print defects such as density drop or image skipping can be prevented.

What is claimed is:

1. An apparatus for detecting toner shortage in a developing unit for use in an image recording system that forms a latent electrostatic image on a carrier by exposure to an image signal and that develops the latent electrostatic image to produce a recorded image formed of pixels, said apparatus comprising:

a container for holding toner;

toner shortage sensor means disposed in the container for detecting presence and absence of toner at a predetermined location in the container;

counter means for determining a cumulative total of recorded images and pixels produced by the image recording system, wherein the counter means adds incrementally to the cumulative totals when the toner shortage sensor means detects the absence of toner at the predetermined location int he container, and wherein the counter means subtracts incrementally from the cumulative totals when the toner shortage sensor means detects the presence of toner at the predetermined location in the container; and control means governed by the counter means for stopping the operation of the image recording system when the cumulative total of either the recorded images or pixels reaches a respective predetermined value.

2. The apparatus according to claim 1, wherein the toner shortage sensor means includes a piezoelectric device.

3. The apparatus according to claim 1, further comprising memory means for storing the cumulative totals for the recorded images and pixels in the counter means.

4. The apparatus according to claim 1, further comprising display means responsive to the control means to display a message for toner shortage in the developing unit, while the control means stops the operation of the image recording system.

5. The apparatus according to claim 1, wherein the image recording system is a remote printer which performs a recording operation for the image signals supplied continuously form a host computer on a round-the-clock basis.

6. The apparatus according to claim 1, wherein the predetermined value of recorded images if 600.

7. The apparatus according to claim 1, wherein the predetermined value of pixels is $2.1 \times 10^7$.

* * * * *

UNITED STATES PATENT AND TRADEMARK OFFICE

CERTIFICATE OF CORRECTION

PATENT NO. : 5,160,966

DATED : November 3, 1992

INVENTOR(S) : Yoshio Shiina et al.

It is certified that error appears in the above-indentified patent and that said Letters Patent is hereby corrected as shown below:

Title Page:
Abstract, line 1, change "a" (first occurrence) to --an--.

Abstract, line 18, change "sumulative" to --cumulative--.

Claim 1, column 12, line 13, change "int he" to --in the--.

Claim 5, column 12, line 37, change "form" to --from--.

Claim 6, column 12, line 40, change "if" to --is--.

Signed and Sealed this

First Day of February, 1994

Bruce Lehman

*Attest:*

BRUCE LEHMAN

*Attesting Officer*

*Commissioner of Patents and Trademarks*